US007112301B2

(12) United States Patent
Thorne et al.

(10) Patent No.: US 7,112,301 B2
(45) Date of Patent: Sep. 26, 2006

(54) HIP MANUFACTURE OF A HOLLOW COMPONENT

(75) Inventors: George Thorne, Bristol (GB); Robert Charles Tonks, Bridgwater (GB); Wayne Eric Voice, Nottingham (GB)

(73) Assignee: Rolls-Royce plc, London (GB)

( * ) Notice: Subject to any disclaimer, the term of this patent is extended or adjusted under 35 U.S.C. 154(b) by 27 days.

(21) Appl. No.: 10/813,395

(22) Filed: Mar. 31, 2004

(65) Prior Publication Data

US 2005/0135958 A1 Jun. 23, 2005

(30) Foreign Application Priority Data

Apr. 1, 2003 (GB) ..... 0307523.1

(51) Int. Cl.

| | |
|---|---|
| ***B22F 5/10*** | (2006.01) |
| ***B22F 3/15*** | (2006.01) |
| ***B28B 1/30*** | (2006.01) |
| *B28B 7/34* | (2006.01) |

(52) U.S. Cl. ..... 419/5; 419/49; 264/635

(58) Field of Classification Search ..... 419/6, 419/8, 49, 5, 7; 264/635, 604

See application file for complete search history.

(56) References Cited

U.S. PATENT DOCUMENTS

| | | | | |
|---|---|---|---|---|
| 3,753,704 | A * | 8/1973 | Manilla et al. | 419/8 |
| 3,992,202 | A * | 11/1976 | Dulis et al. | 419/5 |
| 3,996,048 | A | 12/1976 | Fiedler | |
| 4,627,958 | A * | 12/1986 | Hays | 419/8 |
| 5,130,084 | A | 7/1992 | Matheny et al. | |
| 6,042,780 | A * | 3/2000 | Huang | 419/36 |
| 6,274,083 | B1 | 8/2001 | Clark, III | |
| 2003/0173720 | A1 * | 9/2003 | Musso et al. | 264/635 |

* cited by examiner

*Primary Examiner*—Ngoclan T. Mai
(74) *Attorney, Agent, or Firm*—Oliff & Berridge, PLC

(57) ABSTRACT

Forming a hollow structure having an internal coating includes the steps of placing a core shaped to form the internal surface of the structure in a mould, filling the mould with a material powder, hot isostatically pressing the powder about the mould to consolidate the powder, and removing the core from the hollow structure formed, wherein a coating is applied to the core prior to placement in the mould, which coating bonds to the hollow structure formed, during the hot isostatic pressing, to form the internal coating.

5 Claims, 5 Drawing Sheets

HIP MANUFACTURE OF A HOLLOW COMPONENT

The present invention relates to the manufacture of a component using hot isostatic pressing (HIPing) and in particular provides a method of manufacturing a nozzle, for a gas turbine engine, provided with an internal coating.

There is increasing interest in the use of two-dimensional, or "letterbox" type, nozzles for the exhausts of gas turbine engines. However, such nozzles are difficult to manufacture, typically requiring fabrication from a number of different elements. Such fabrication comprises the functionality of the nozzles by introducing regions of local weakness where welding is used to joint parts, or possible leakage paths where mechanical fastenings are used.

Another problem faced with two-dimensional nozzles is the application of heat resistant coatings to their internal faces. Such heat resistant coatings, typically ceramic, are applied by air plasma spraying (APS) and enable an improvement in the performance of the nozzle. However, APS is ill suited to the geometries of the two dimensional nozzles. Such nozzles typically have an aspect ratio of seven to one, with a weight of, say, 150 mm and concomitant width of 1 m. As APS guns typically have spray heads about 100 mm high and require a stand off distance of about 1 m, it will be understood that coating the internal surface of the nozzle is not possible using conventional APS technology.

According to the present invention there is provided method of forming a hollow structure having an internal coating comprising the steps of placing a core shaped to form the internal surface of the structure in a mould, filling the mould with a material powder, hot isostatically pressing the powder about the mould to consolidate the powder, and removing the core from the hollow structure formed, wherein a coating is applied to the core prior to placement in the mould, which coating bonds to the hollow structure formed, during the hot isostatic pressing, to form the internal coating.

According to a further aspect of the present invention, there is provided a core for use in the manufacture of a hollow component having an internal coating, wherein the core is provided with an external coating which bonds to the hollow component during the manufacturing process, such that removal of the core leaves the external coating applied to the hollow component.

The present invention will now be described in more detail according to the accompanying drawings, in which.

Figure 1:
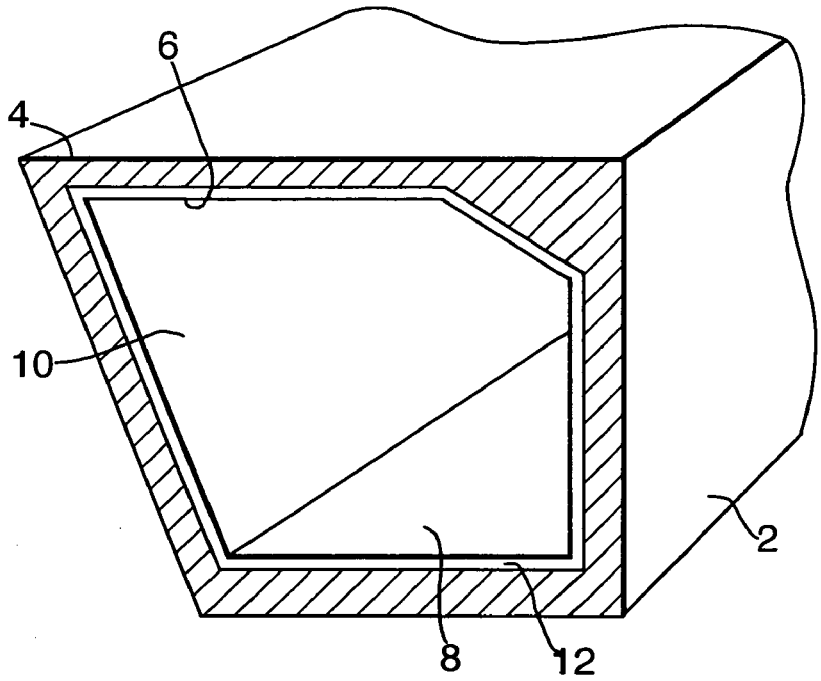
FIG. 1 shows a perspective view of a gas turbine engine nozzle.

FIG. 1 shows a perspective view of a gas turbine engine nozzle 2, manufactured according to the present invention. The nozzle 2 comprises a hollow structure of with constant rectilinear external cross-section 4 and a constant, rectilinear, internal cross-section 6. The nozzle 2 defines an open-ended conduit between a gas turbine engine (not shown) and an exit aperture 8. The cavity 10 defined by the nozzle 2 is provided with a ceramic coating 12, which is able to withstand the temperature of the hot gasses, which pass through the nozzle 2 during operation of the gas turbine engine.

Figure 2:
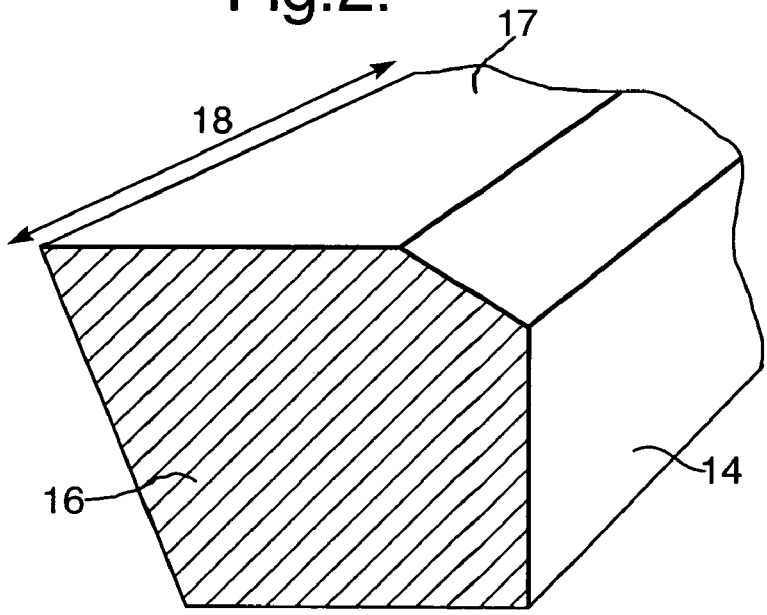
FIG. 2 shows a perspective view of a solid core for use in the manufacture of the nozzle of FIG. 1.

FIG. 2 shows a perspective view of a solid core 14, made of mild steel. The core 14 has a cross-section 16 which corresponds to the internal cross-section 6 of the finished nozzle 2, manufactured by the process described hereafter. The external surface 17 of the core 14 is provided with a very good surface finish, with little roughness.

Figure 3:
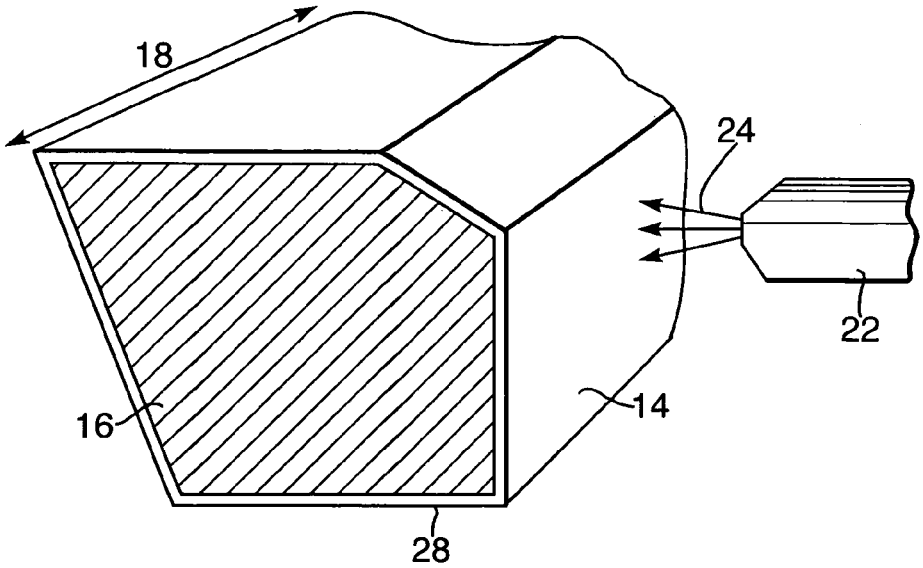
FIG. 3 shows a perspective view of the core of FIG. 2 in a later stage of the manufacturing process.

The core 14 shown is a simple two-dimensional structure with a constant cross-section 16 along its length 18. It will be understood, however, that a more complex external geometry may be used, for example where the cross-section 16 varies along the length 18 of the core 14, where a gas turbine nozzle with more complex internal geometry is to be manufactured. Turning to FIG. 3, a coating 20 is applied to the core 14 by air plasma spraying, wherein a heat source is used to spray molten materials to form a surface coating. An inert gas passing through an electric field is transformed into high temperature plasma, which is expanded through the chamber of a plasma gun 22. The plasma 24 then exits the gun 22 at high temperature (up to 10,000° C.) and velocity. Coating material, in powder form, is injected into this plasma 24 where it gains both thermal and kinetic energy. Momentum propels molten droplets of the coating material forwards, towards the component 14, where they solidify at the surface. An incremental process of splat formation then builds up a full thickness of coating 20.

Figure 4:
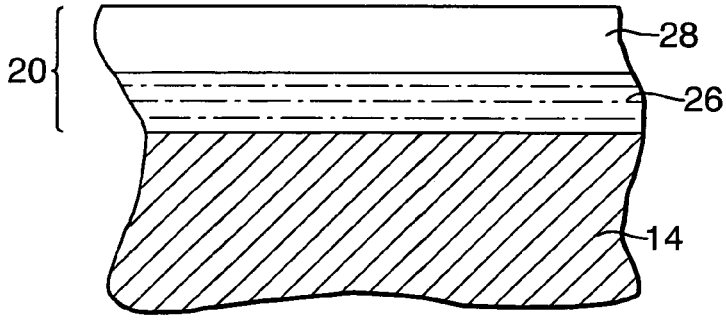
FIG. 4 shows a cross section through the core of FIG. 2 and a coating applied thereto.

FIG. 4 shows a cross section through the coating 20 applied to the core of FIG. 3 in more detail. The coating 20 comprises a first layer 26, between about 2.5 to 3.0 mm thick of an alumina-based ceramic, which is laid down first by the air plasma deposition process. A second layer 28, about 0.5 mm thick, of a MCrAlY type alloy (where M=Co, Ni or Co/Ni) is then applied on top of the first layer 26. Because of the very good surface finish of the core 14, the bond between the ceramic 32 and the core 14 is relatively weak.

Figure 5:
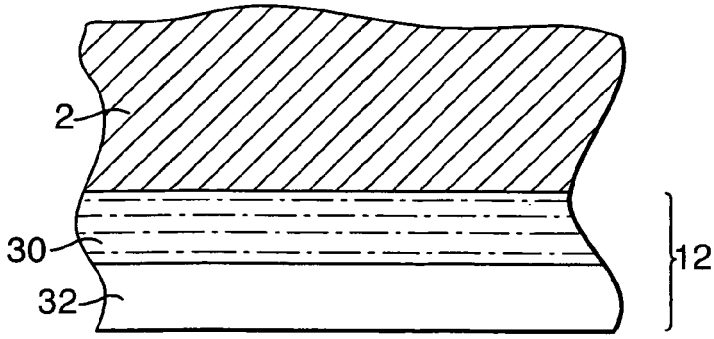
FIG. 5 shows a cross section through a part of the nozzle of FIG. 1 and an internal coating applied thereto.

The coating 20 applied to the core 14 then comprises, in essence, a mirror image of the final coating 12 applied to the finished nozzle 2. This coating is shown in more detail at FIG. 5.

The final coating 12 resembles a typical thermal barrier coating of the type well known in gas turbine engine applications, applied to hot end components such as combustors and turbine blades and stators. The coating comprises a first coating 30 of MCrAlY bonded to the nozzle 2 and an overlayed, alumina-based ceramic coating 32. The first coating 30 of MCrAlY serves as a bond coat, which enhances adhesion of the ceramic coat 32 to the component 2, and which is sufficiently ductile at operating temperature accommodate differential thermal expansion between the two 22,24.

Figure 6:
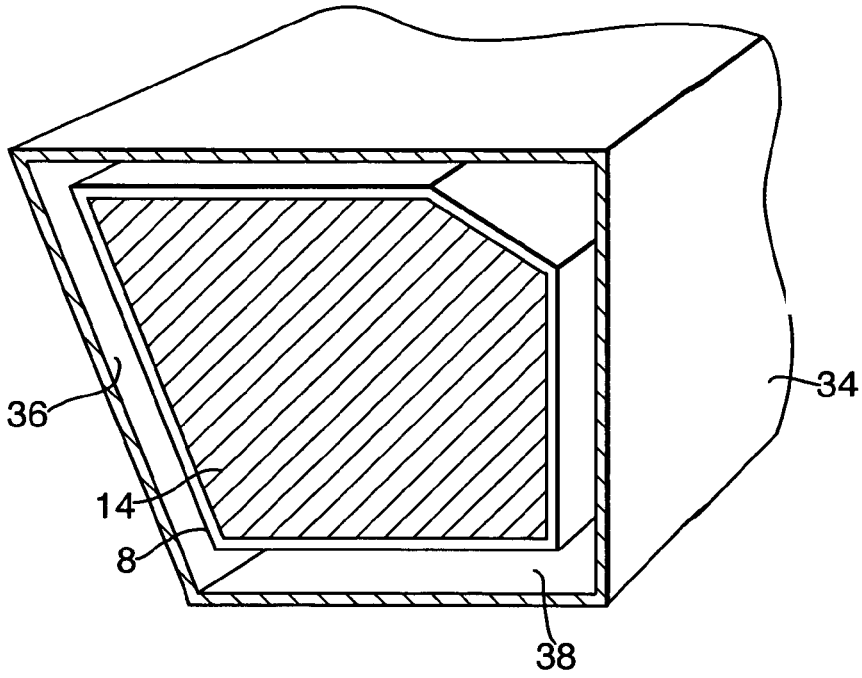
FIG. 6 shows a sectioned, perspective view of the core of FIG. 3 placed in a mould.

Turning to FIG. 6, the coated core 14,8 is enclosed within a closed mould 34 whose internal cavity cross-section 36 is of similar shape to the external cross-section of the nozzle 2 but of a slightly too large size. The reason for this will be disclosed further hereafter. A cavity 38 is thus defined between the core 14 and the mould 34.

Figure 7:
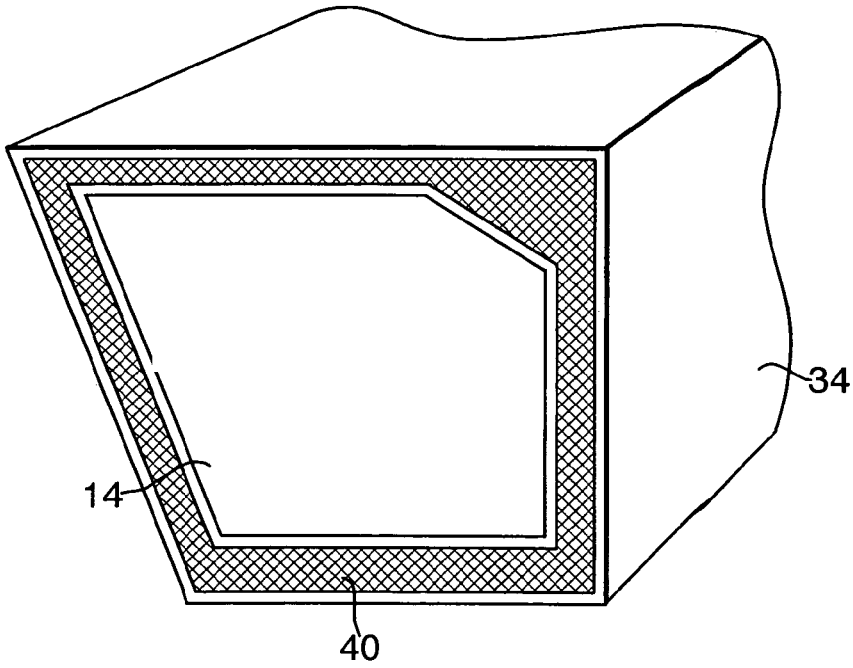
FIG. 7 shows a sectioned, perspective view of the core and mould of FIG. 6 in a later stage of the manufacturing method.

As shown in FIG. 7, the cavity 38 is filled with powdered metal 40, in the present example, a high temperature nickel alloy, also known as nimonic alloy. This alloy 40 is packed into the cavity 10.

Figure 8:
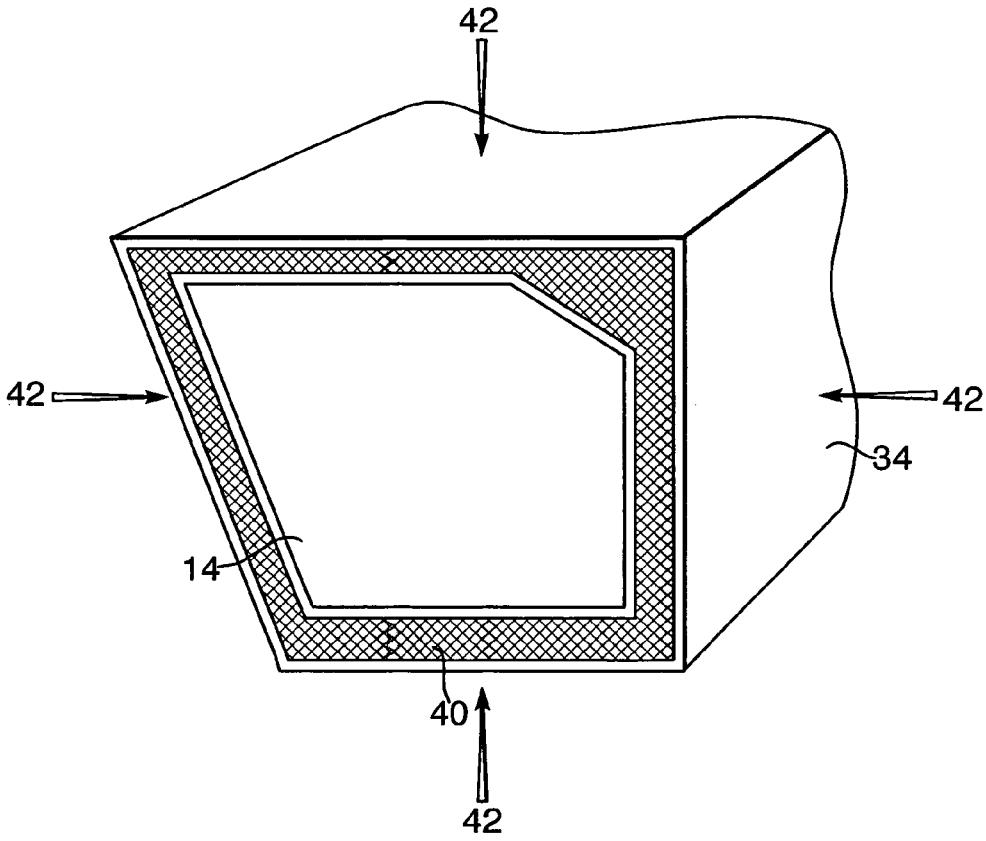
FIG. 8 shows a sectioned, perspective view of the core and mould of FIG. 6 in a still later part of the manufacturing method.

Turning to FIG. 8, the mould 40 is then compressed under a uniform pressure 42 and at elevated temperature in a process known as hot-isostatic pressing. This process is well known and will not be described herein in further detail than necessary to understand the present invention. The temperature and pressure of the hot isostatic pressing process are such that the metal powder 40 consolidates about the core 14, to form a solid alloy with material properties substantially similar to a conventionally cast or forged alloy. The MCrAlY bond coat 28, presented at the interface between core 14 and powder bonds to the powder 40 with a stronger bond than that between the ceramic coating 26 and the core 14. This ensures that the coating 12 as a whole preferentially bonds to the consolidated metal powder 40, with a stronger bond than between the coating 12 and the core 14.

Figure 9:
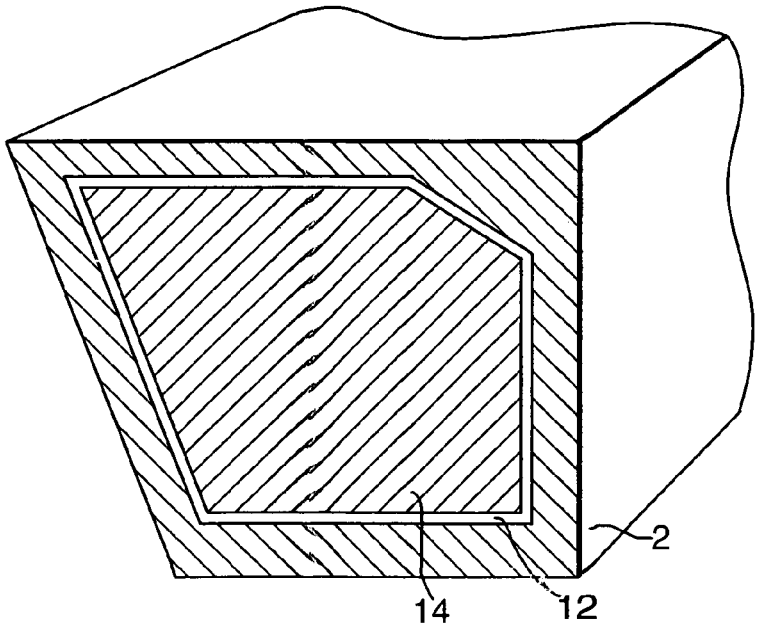
FIG. 9 shows a sectioned, perspective view of the consolidated part produced by the manufacturing method herein.

Turning to FIG. 9, after the hot isostatic pressing, the consolidated nozzle 2 is removed from the mould 40. The nozzle 2, at this stage comprises a hollow structure having an internal coating, surrounding a mild steel core 14. The mild steel core 14 is then removed by a process known as "pickling" in which a leaching agent, strong nitric acid in the present embodiment, is used to leach the mild steel core out of the structure 2. The agent is chosen such that it does not substantially damage the ceramic coating 12.

After the core 14 has been removed, a final hollow structure 2 with an internal coating 12 is left, as shown in FIG. 1.

In a further embodiment of the process described hereinbefore, the nozzle 2 is manufactured from a titanium alloy. We have found that in this case, it is beneficial to omit the MCrAlY bond coat described hereinbefore, and instead use a graded transition between ceramic and titanium. This will be seen in more detail if reference is now made to FIG. 10.

Figure 10:
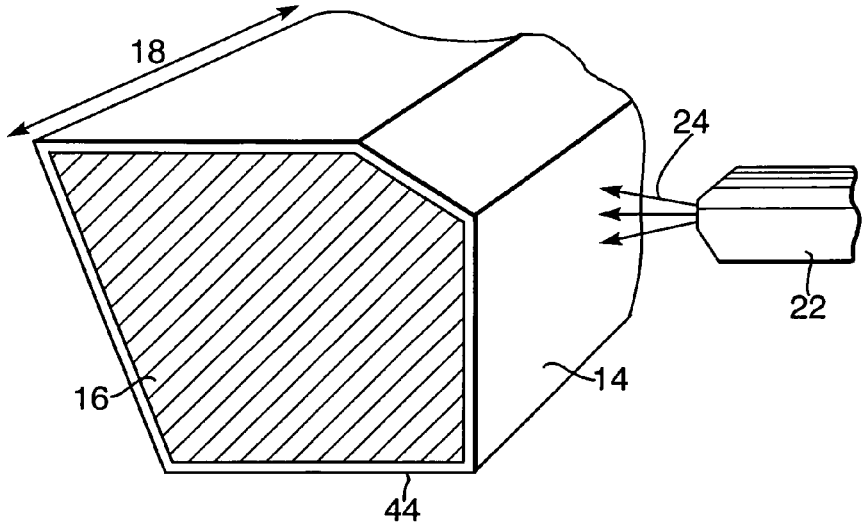
FIG. 10 shows a perspective view of a core used in a further embodiment of the present invention.

FIG. 10 shows a mild steel core 14 substantially as per the previous embodiment. However, the core is coated with a coating 44, which is shown in more detail in FIG. 11. Again, the coating is applied by air plasma deposition (APD).

Figure 11:
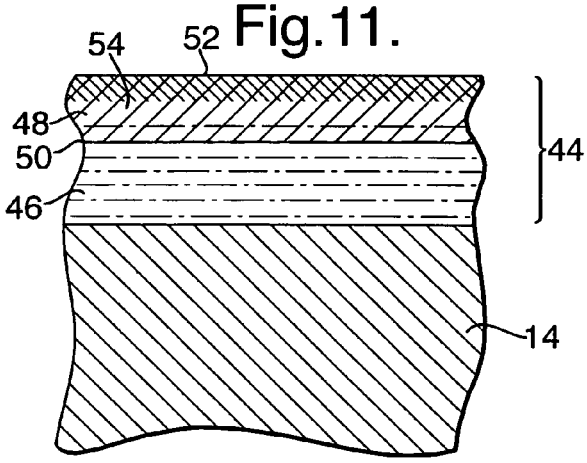
FIG. 11 shows a cross-section through a part of the core of FIG. 10 and coating applied thereto.

FIG. 11 shows a cross-section through the coating 44 of FIG. 10. The coating 44 comprises an alumina-based ceramic first coating 46, again about 2.5 to 3.0 mm thick, which is applied directly to the core 14. A second, blended coating 48, about 0.5 mm thick, of alumina-based ceramic and titanium alloy is applied over the first coat 46.

The second coating 48 is graded such that at the interface 50 between first coat 46 and second coat 48, the coating 48 is about 100% ceramic and about 0% titanium alloy, and at the surface of the coating 48 it is about 100% titanium alloy and about 0% ceramic. There is a constant variation across the coating such that, at the midpoint 54 between interface 48 and outer surface 52, the coating is about 50% ceramic and about 50% titanium alloy.

Figure 12:
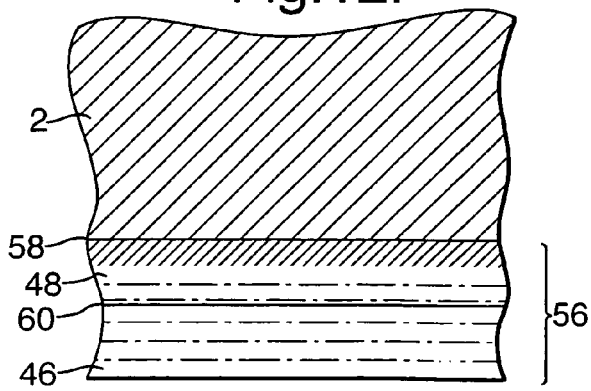
FIG. 12 shows a cross-section through a part of a nozzle produced via the further embodiment and an internal coating applied thereto.

As with the previous embodiment, the coated core 14,44 is placed within a mould 34. However, instead of a nickel alloy powder 40, a titanium alloy powder is packed into the cavity 38 formed between the mould 34 and the core 14. This titanium alloy powder is then consolidated under hot isostatic pressing. As before, the coating 44 preferentially bonds with the titanium alloy powder during the consolidation process. The core is subsequently leached away to leave a nozzle as shown in FIG. 1, made instead of titanium alloy. The coating 56 is substantially different to the coating 12 disclosed in the previous embodiment and is shown at FIG. 12.

The coating 56 comprises a bond coat 48, bonded to the nozzle 2 and an overlying ceramic coat 46. The bond coat 48 is the graded second coat applied to the core 14. This coating 48 is about 100% titanium alloy at the interface 58 between nozzle 2 and coating 56, and about 100% ceramic at the interface 60 between the bond coat 48 and ceramic coat 46. Such a coating 56 has a much better thermal expansion match with the titanium alloy nozzle than would be the case with a MCrAlY/Ceramic coating as described in the previous embodiment.

Alternatives

Nozzle Material

Although the embodiments herein disclose titanium alloy and nimonic alloy powder for the nozzle 2 material, it will be understood that other materials may be used such as high temperature stainless steels and titanium aluminides.

Similarly, the disclosure of an alumina based ceramic is not intended to be limiting, and other ceramics may be used such as silica and zirconia based ceramics.

Coating Deposition

The use of air plasma spraying (APS) is not intended to be limiting. The invention disclosed herein is equally suitable to low pressure plasma spraying (LPPS), vacuum plasma spraying (VPS) and also physical vapour deposition (VPD).

Coating Thickness

The bond coat 28,48 applied to the ceramic coating 26,46 is ideally between about 0.12 mm and 1.0 mm, and preferably 0.5 mm, however, the invention is not limited to bond coats of only these thickness.

Similarly, the ceramic coating 26,46 is ideally between about 1 mm and 5 mm in thickness and ideally, between about 2.5 mm and 3.0 mm in thickness, however the invention is not limited to the use of ceramic coatings of only these thickness.

The invention claimed is:

1. A method of forming a hollow structure having an internal coating comprising the steps of:
   - placing a core shaped to form the internal surface of the structure in a mould,
   - filling the mould with a material powder,
   - hot isostatically pressing the powder about the mould to consolidate the powder, and
   - removing the core from the hollow structure formed,
   - wherein a coating is applied to the core prior to placement in the mould, which coating bonds to the hollow structure formed, during the hot isostatic pressing, to form the internal coating,
   - wherein the coating applied to the core comprises a first coating applied to the core and a second coating applied over the first coating, and
   - wherein the first coating is a ceramic coating and the second coating is a bond coating, such that the coating as a whole preferentially bonds to the powder consolidated about the core during the hot isostatic pressing process.

2. A method as claimed in claim 1 wherein the second coating comprises a MCrAlY bond coat.

3. A method as claimed in claim 1 wherein the second coating comprises a ceramic-metal mix bond coat, the proportions of metal in the coating varying from about 0% at the surface of the core to about 100% at the coating extremity.

4. A method of forming a hollow structure as claimed in claim 1 wherein the core is made of mild steel and its removal is effected by use of a chemical agent.

5. A method of forming a hollow structure having an internal coating comprising the steps of placing a core shaped to form the internal surface of the structure in a mould, filling the mould with a material powder, hot isostatically pressing the powder about the mould to consolidate the powder, and removing the core from the hollow structure formed, wherein a coating is applied to the core prior to placement in the mould, which coating bonds to the hollow structure formed, during the hot isostatic pressing, to form the internal coating, and wherein the core is made of mild steel and its removal is effected by use of a chemical agent.

* * * * *